US008123667B2

(12) United States Patent
Droste et al.

(10) Patent No.: US 8,123,667 B2
(45) Date of Patent: Feb. 28, 2012

(54) CENTRIFUGE, IN PARTICULAR SEPARATOR, HAVING A FEED LINE FOR CONTROL FLUID

(75) Inventors: Johannes Droste, Rosendahl (DE); Norbert Wegener, Oelde (DE)

(73) Assignee: Westfalia Separator AG, Oelde (DE)

( * ) Notice: Subject to any disclaimer, the term of this patent is extended or adjusted under 35 U.S.C. 154(b) by 784 days.

(21) Appl. No.: 12/160,983

(22) PCT Filed: Jun. 12, 2007

(86) PCT No.: PCT/EP2007/055751

§ 371 (c)(1),
(2), (4) Date: Jul. 15, 2008

(87) PCT Pub. No.: WO2007/144339

PCT Pub. Date: Dec. 21, 2007

(65) Prior Publication Data

US 2009/0270238 A1 Oct. 29, 2009

(30) Foreign Application Priority Data

Jun. 14, 2006 (DE) ..... 20 2006 009 331 U

(51) Int. Cl.
*B04B 1/18* (2006.01)

(52) U.S. Cl. ..... 494/28; 494/2

(58) Field of Classification Search ..... 494/1–6, 494/10–11, 23, 25–30, 43, 67–73
See application file for complete search history.

(56) References Cited

U.S. PATENT DOCUMENTS

| | | | | |
|---|---|---|---|---|
| 2,564,899 | A | | 8/1951 | Harstick |
| 2,723,799 | A | * | 11/1955 | Sharples ..... 494/10 |
| 2,820,589 | A | * | 1/1958 | Fitzsimmons ..... 494/4 |
| 3,408,001 | A | | 10/1968 | Nilsson |
| 3,938,734 | A | | 2/1976 | Wilke |
| 4,159,798 | A | | 7/1979 | Grimwood et al. |
| 4,479,788 | A | | 10/1984 | Kohlstette |
| 4,717,376 | A | | 1/1988 | Bruning et al. |
| 4,781,670 | A | | 11/1988 | Kohlstette |

FOREIGN PATENT DOCUMENTS

| | | | |
|---|---|---|---|
| DE | 924979 | | 3/1955 |
| DE | 1 532 676 | | 2/1970 |
| DE | 28 22 478 | A1 | 12/1978 |
| DE | 3109346 | A1 * | 11/1982 |
| DE | 38029 158 | A1 | 3/1990 |
| DE | 2 022 197 | | 6/2002 |
| DE | 202 02 197 | U1 | 7/2002 |
| WO | WO 96/08313 | A1 | 3/1996 |

* cited by examiner

*Primary Examiner* — Charles E Cooley
(74) *Attorney, Agent, or Firm* — Barnes & Thornburg LLP

(57) ABSTRACT

A separator includes a rotatable centrifugal drum having a vertical axis of rotation. The separator includes a rotatable drive spindle to drive the drum, an hydraulic system located in an interior of the drum and at least one feed line to feed a control fluid to the drum, the at least one feed line having an outlet region. Further included is a ring non-rotatably connected to the drum, a gap located between one of the drive spindle and the drum and the drive spindle and the ring. The feed line leads out radially in front of the drive spindle in the outlet region. The outlet region is oriented and configured such that emerging control fluid is spread directly against the drive spindle, and a portion of the control fluid enters through the gap into the hydraulic system.

12 Claims, 2 Drawing Sheets

CENTRIFUGE, IN PARTICULAR SEPARATOR, HAVING A FEED LINE FOR CONTROL FLUID

BACKGROUND AND SUMMARY

The present disclosure relates to a centrifuge, particularly to a separator, including a rotatable centrifugal drum having a vertical axis of rotation and a rotatable drive spindle. The separator also includes at least one feed line for a control fluid in a hydraulic system in an interior of the drum.

Separators suitable for industrial use are known from the state of the art. Depending on the type of construction, such separators have a hydraulic system for the evacuation of solids, which hydraulic system has a closing element operable by a control fluid and, as a rule, is constructed as a piston slide.

Another known construction of the state of the art is illustrated in FIG. 2. FIG. 2 shows the lower region of a self-evacuating separator drum having a hydraulic system by which it is possible to carry out controlled partial evacuations of the centrifugal drum.

The hydraulic system comprises a feed line for closing fluid and valve control fluid as control fluid which can be guided in closing chambers a and b. As a result of the centrifugal force, a liquid ring forms in the closing chambers which exercises a force upon the piston slide pressing the latter into a position at the top, in which it closes the solids discharge openings. If an evacuation of the drum is to be carried out, the valve c is opened by opening fluid.

As illustrated, the control fluid is fed by control fluid feed lines which extend relatively close to the spindle parallel to the latter vertically upward into the drum, in whose interior they spray the control fluid radially toward the outside into the feed lines to the closing chambers and to the valve c.

Such constructions are known from U.S. Patent Documents U.S. Pat. No. 4,479,788 and U.S. Pat. No. 3,938,734 and German Patent Document DE 1532676 OS of the above-mentioned type. A further centrifuge of the above-mentioned type is known from German Patent Document DE AS 2 022 197. German Patent Document DE 924 979 PS shows the direct injection of control fluid from a ring into a chamber at the bottom part of the centrifuge.

Constructions requiring still higher expenditures are illustrated in U.S. Patent Documents U.S. Pat. No. 4,717,376 and U.S. Pat. No. 4,781,670 or German Patent Document DE 38 29 158 A1. According to the latter document, liquid is led through a spindle into the drum bottom part.

Furthermore, it is known from International Patent Document WO 96/08313 A1 to direct the feed line for the control fluid radially in front of the drive spindle to a deflector which guides the liquid through a gap between the drive spindle and the centrifugal drum or a part non-rotatably connected with the centrifugal drum into the hydraulic system in the interior of the drum. Here also, the still relatively high constructive expenditures present a problem.

With respect to the technology herein, see U.S. Patent Document U.S. Pat. No. 2,564,899.

The present disclosure relates to a separator having a simplification of the control liquid feeding into the centrifugal drum.

The present disclosure relates to a separator that includes a rotatable centrifugal drum having a vertical axis of rotation, a rotatable drive spindle to drive the drum and a hydraulic system located in an interior of the drum. Also included is at least one feed line to feed a control fluid to the drum, the at least one feed line having an outlet region. Further included is a ring non-rotatably connected to the drum, a gap located between one of the drive spindle and the drum and the drive spindle and the ring. The feed line leads out radially in front of the drive spindle in the outlet region. The outlet region is oriented and configured such that emerging control fluid is spread directly against the drive spindle, and a portion of the control fluid enters through the gap into the hydraulic system.

Accordingly, the feed line for the control fluid leads out radially in front of the drive spindle in an outlet region. The outlet region is oriented and arranged such that the exiting control fluid can be sprayed directly against the drive spindle in such a manner that a portion of the control fluid, or the entire control fluid, enters into the hydraulic system in the interior of the drum through a gap between the drive spindle and the centrifugal drum or a part non-rotatably connected with the centrifugal drum. Concretely, this means that no deflector or other deflecting device is situated between the outlet from the feed line for the control fluid and the drive spindle.

As a result, it is no longer be necessary to guide the control fluid feed line itself directly into the centrifugal drum. Thus, the drum shell or the part non-rotatably connected with the centrifugal drum can radially extend relatively close and almost directly to the drive spindle.

Unexpectedly, the deflector of International Patent Document WO 9608313A1 can also be useful. That is because it was found that, despite the rotation of the spindle, a deflection of the fluid jet, such as water, for example, which is used as the fluid, into drum also takes place at the rotating spindle, so that the fluid system in the interior of the drum is excellently fed with fluid.

It may be advantageous for the spindle to have a relatively smooth surface in the region in which the water jet impacts and in which the spindle enters the drum. That is, the spindle should have no unevennesses which would undesirably deflect the water jet. In particular, no grooves or abrupt diameter changes should exist in the region. The spindle should have a constant or slightly conical diameter.

As an alternative, the spindle could have a conical construction.

As seen in FIG. 2, a relatively large radial gap between the drive spindle and the drum or a part, such as a ring, non-rotatably connected with the drum can, in addition, clearly be reduced in this manner. And, among other advantages, that has the advantage that the control fluid overflow diameter in the centrifugal drum can move closer to the center.

The outlet region is designed as an outlet nozzle, and the outlet nozzle is oriented such that that the control fluid is injected at an acute angle. That is, at an angle relative to the axis of rotation which is between 0° and 90°, or between 20° and 70° without elements situated in-between, such as a deflector, against the drive spindle in the region of the gap. This is an advantageous implementation, according to the present disclosure.

The hydraulic system, which can be fed with fluid, may, for example, be used for the operation of many different evacuation mechanisms, such as the controlling of piston slides, membranes, piston valves and/or piston-slide-like constructions.

Other aspects of the present disclosure will become apparent from the following descriptions when considered in conjunction with the accompanying drawings.

DETAILED DESCRIPTION

Figure 2:
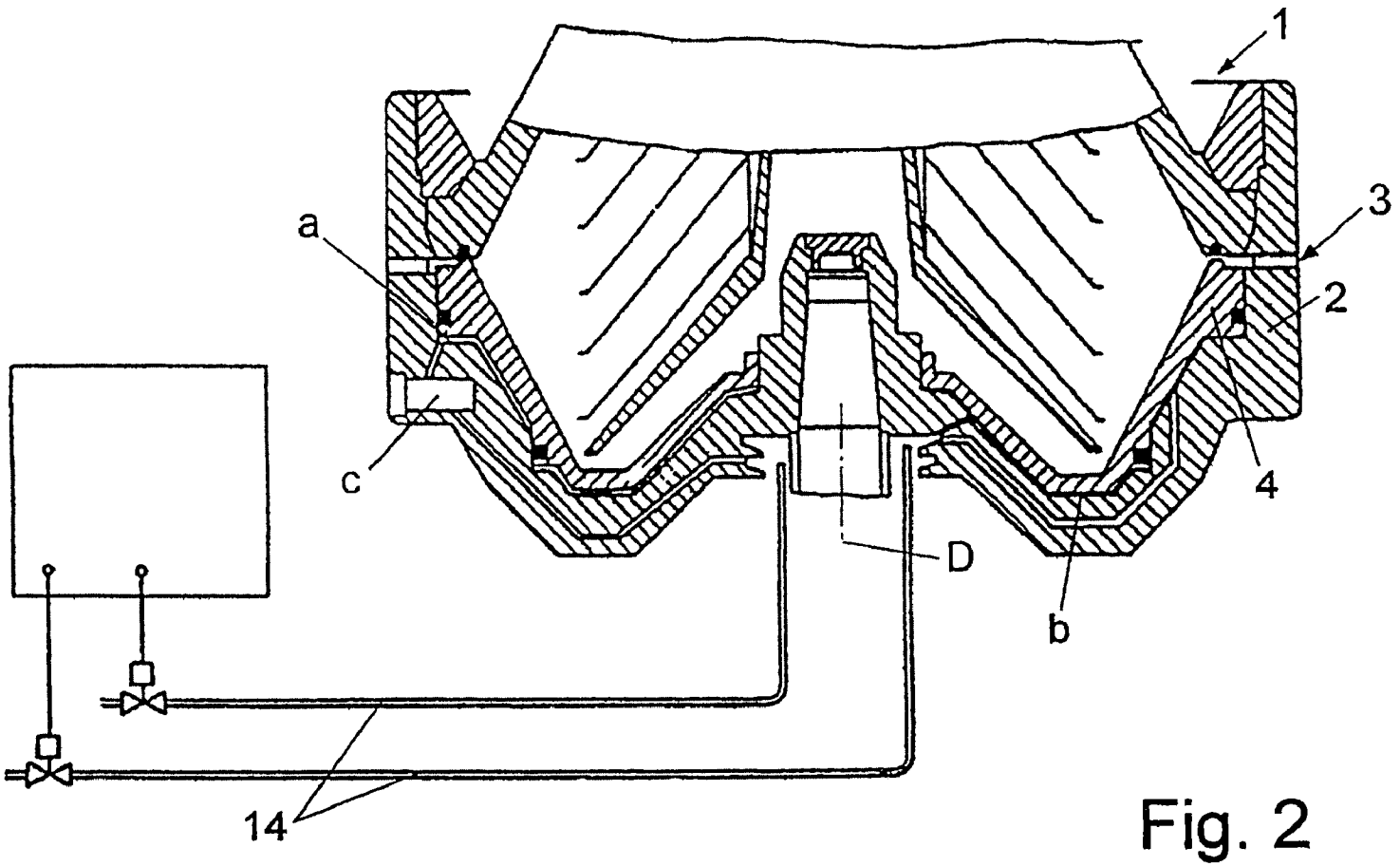
Fig. 2 PRIOR ART
FIG. 2 is a sectional view of a separator drum, according to the state of the art.

FIG. 2 illustrates a lower partial region of a separator 1 having a centrifugal drum 2 with a vertical axis of rotation D. Drum 2 has fluid outlets (not shown) and at least one solids discharge opening 3 to which a piston slide 4 is assigned. The piston slide 4 is hydraulically operated by a control fluid.

The control fluid is guided through at least one feed line 14, shown in FIG. 2 as two feed lines 14, for feeding the control fluid to the centrifugal drum 1.

Figure 1:
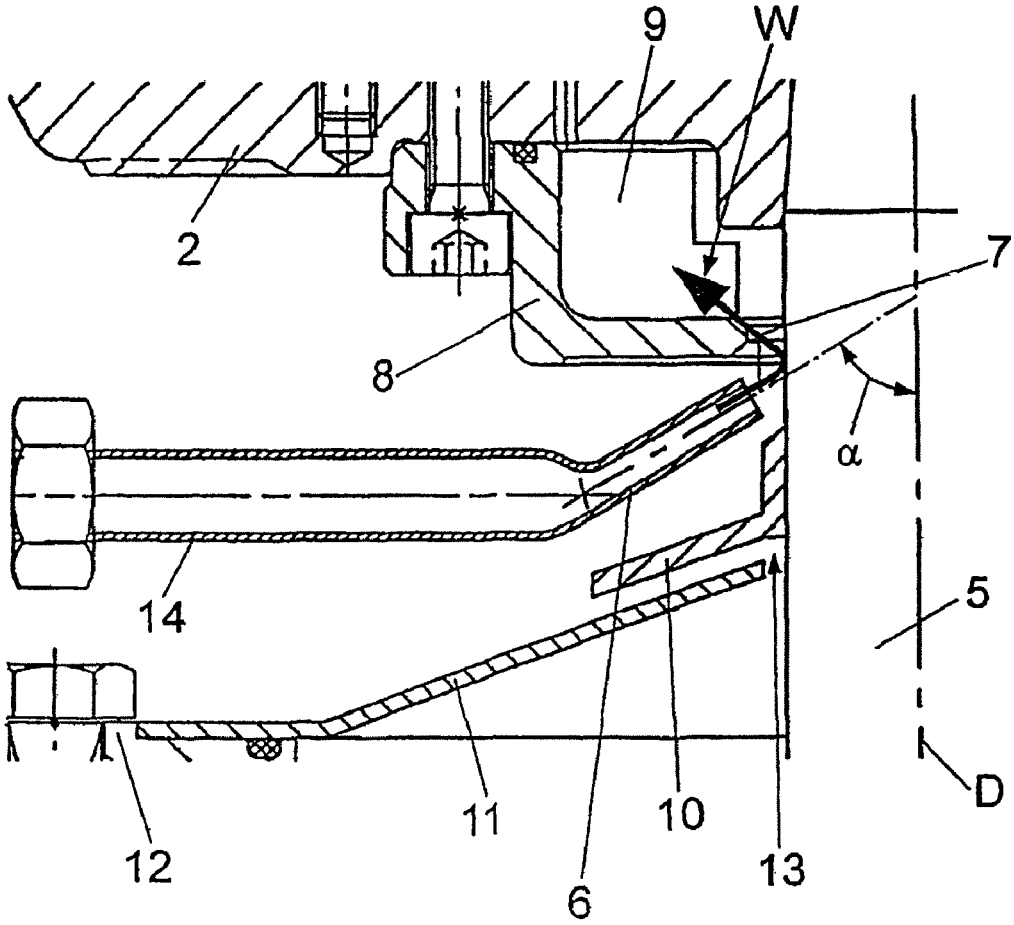
FIG. 1 is a sectional view of a section of a separator, according to the present disclosure, illustrating control fluid feeding into a centrifugal drum.

The separator shown in FIG. 1, according to the present disclosure, may, for example, have a construction analogous to or including portions of the separator of FIG. 2 or may have a different construction. For example, at least one feed line 14 for the control fluid ends radially in front of the drive spindle 5 in an outlet region, such as outlet region or nozzle 6, which is oriented such that the control fluid is sprayed at an acute angle a relative to the axis of rotation D against the drive spindle 5. The angle $\alpha$ is between 0° and 90°, or may be between 20° and 70°.

The outlet nozzle 6 is oriented such that at least a portion of the control fluid emerging from the outlet nozzle 6 enters through an annular gap 7 between the drive spindle 5 and the centrifugal drum 2. Or, the control fluid enters between the gap 7 and a part non-rotatably connected with the drum, such as a ring 8. The control fluid enters from below into the centrifugal drum 2 and thereby also into a control fluid line, or hydraulic system 9, of the drum 2, as shown by arrow W illustrating the entry of the control fluid. The control fluid can be used for operating the piston slide 4 in the manner suggested in FIG. 2 or, as required, also for operating other fluid-operated devices. A radial dimension of the annular gap 7 between the drive spindle 5 and the drum 2, or the ring 8, amounts to only 0.5 mm to 10 mm, or 1 mm to 4 mm.

The outlet nozzle 6 is designed such that it generates a directed jet of a relatively constant diameter, which essentially does not fan out. That is, if possible, the jet should have a diameter in an impact region that is smaller than the spindle diameter. That is, smaller than 50%, or less than 35% of the spindle diameter.

Below the outlet nozzle 6, a centrifugal ring 10 is arranged on the drive spindle 5.

This centrifugal ring 10 has a conical shape. The ring 10 projects radially above or beyond a conically shaped deflector or covering 11 at a machine frame 12. The covering 11 does not rotate along in an operation and projects up to the drive spindle 5 except for an annular gap 13 between the covering 11 and drive spindle 5. According to the present disclosure, a stepped shape of the centrifugal ring 10 as well as of the covering 11 is also conceivable, for example, cylindrical in a stepped fashion.

As a result, a region below a drum chamber, that is, the space which directly surrounds the centrifugal drum 2 is effectively and easily in a labyrinth-seal-type fashion protected from a penetration of impurities, such as from a penetration of dripping-off control fluid. This results in a protection of the drive region below the covering 11. During a rotation of the drive spindle 5, the centrifugal ring 10 sprays liquid toward the outside, so that it will be effective in the operation.

Although the present disclosure has been described and illustrated in detail, it is to be clearly understood that this is done by way of illustration and example only and is not to be taken by way of limitation. The scope of the present disclosure is to be limited only by the terms of the appended claims.

We claim:

1. A separator comprising:

a rotatable centrifugal drum having a vertical axis of rotation;

a rotatable drive spindle to drive the drum;

an hydraulic system located in an interior of the drum;

at least one feed line to feed a control fluid to the drum, the at least one feed line having an outlet region;

a ring non-rotatably connected to the drum;

a gap located between one of the drive spindle and the drum and the drive spindle and the ring;

a centrifugal ring arranged on the drive spindle below the outlet region of the feed line;

wherein the feed line leads out radially in front of the drive spindle in the outlet region, the outlet region being oriented and configured such that emerging control fluid is spread directly against a portion of the drive spindle having a constant diameter, the constant diameter portion lying at least between the ring and the centrifugal ring, and a portion of the control fluid enters through the gap into the hydraulic system; and further wherein an area lying between the outlet region of the feed line and the constant diameter portion of the drive spindle defines an open region having no intervening deflecting structure situated between the outlet region of the feed line and the constant diameter portion of the drive spindle.

2. The separator, according to claim 1, wherein the outlet region is an outlet nozzle.

3. The separator according to claim 2, wherein the outlet nozzle generates a directed fluid jet.

4. The separator according to claim 2, wherein the outlet nozzle is oriented such that the control fluid is sprayed at an angle $\alpha$ relative to the axis of rotation against the drive spindle in a region of the gap, which angle $\alpha$ is between 0° and 90°.

5. The separator according to claim 4, wherein the angle $\alpha$ relative to the axis of rotation is between 20° and 70°.

6. The separator according to claim 1, wherein a radial gap width of the gap is between 0.5 and 10 mm.

7. The separator according to claim 1, wherein the centrifugal ring has a conical shape.

8. The separator according to claim 1, wherein the centrifugal ring projects radially beyond a covering at a machine frame, which covering does not rotate along during an operation of the separator and projects up to the drive spindle except for an annular gap between the covering and the drive spindle.

9. The separator according to claim 8, wherein the covering has a conical design.

10. The separator according to claim 1, further comprising an evacuation mechanism hydraulically operated by the control fluid, the evacuation mechanism including at least one control chamber acted upon by the control fluid via the feed line.

11. The separator according to claim 1, wherein a radial gap width of the gap is between 1 to 4 mm.

12. The separator according to claim 1, further comprising a centrifugal ring arranged on the drive spindle below the outlet region.

* * * * *